US011128033B1

(12) United States Patent
Shapoury

(10) Patent No.: US 11,128,033 B1
(45) Date of Patent: Sep. 21, 2021

(54) IMPACT RECOVERABLE ANTENNAS

(71) Applicant: The Boeing Company, Chicago, IL (US)

(72) Inventor: Alireza Shapoury, Rancho Palos Verde, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/843,768

(22) Filed: Apr. 8, 2020

(51) Int. Cl.
*H01Q 1/36* (2006.01)
*H01Q 1/42* (2006.01)

(52) U.S. Cl.
CPC ..... *H01Q 1/362* (2013.01); *H01Q 1/364* (2013.01); *H01Q 1/42* (2013.01)

(58) Field of Classification Search
CPC ..... H01Q 1/362; H01Q 1/364
USPC ..... 341/895
See application file for complete search history.

(56) References Cited

U.S. PATENT DOCUMENTS 5,574,472 A * 11/1996 Robinson ..... B64G 1/22 29/600
5,596,797 A * 1/1997 Bumsted ..... H01Q 1/362 264/251
5,757,324 A * 5/1998 Helms ..... H01Q 1/42 343/700 MS
8,436,784 B2 5/2013 Mazlouman et al.
2004/0132505 A1* 7/2004 Leclerc ..... H01Q 1/362 455/575.1
2004/0196204 A1* 10/2004 Shirosaka ..... H01Q 9/26 343/853
2009/0224990 A1* 9/2009 Cezanne ..... H04B 7/10 343/726
2010/0207811 A1* 8/2010 Lackey ..... G01S 19/35 342/357.44
2013/0016024 A1* 1/2013 Shi ..... H01Q 1/521 343/833
2013/0271343 A1* 10/2013 Thomas ..... H01Q 7/00 343/867
2014/0320376 A1* 10/2014 Ozdemir ..... H01Q 9/0442 343/876
2016/0169951 A1* 6/2016 Robinson ..... G01R 29/10 343/703

(Continued)

OTHER PUBLICATIONS

Olson et al., Deployable Wideband UHF Antenna for Small Satellites, Caltech Professor Sergio Pellegrino Space Structures Laboratory, 2015, pp. 1-5, http://www.pellegrino.caltech.edu/deployable-wideband-uhf-antenna-for-small-satellites, accessed Apr. 8, 2020.

(Continued)

*Primary Examiner* — Lam T Mai
(74) *Attorney, Agent, or Firm* — Kunzler Bean & Adamson

(57) ABSTRACT

Disclosed herein is an impact recoverable antenna assembly. The antenna assembly includes, in certain examples, a conductive antenna element that is deformable from a default configuration to a deformed configuration in response to a deformation event. The conductive antenna element includes a first layer and a second layer that at least partially surrounds the first layer. In certain examples, one of the first layer or the second layer comprises a shape memory alloy configured to deform the conductive antenna element from the deformed configuration to the default configuration in response to a restoration event.

20 Claims, 9 Drawing Sheets

(56) References Cited

U.S. PATENT DOCUMENTS

| | | | | |
|---|---|---|---|---|
| 2018/0026373 | A1* | 1/2018 | Schwent | H01Q 21/28<br>343/748 |
| 2020/0166651 | A1* | 5/2020 | Ailor, III | G01S 19/35 |

OTHER PUBLICATIONS

Conductive Nitinol Clad Wire, Anomet Products, pp. 1-4, http://www.anometproducts.com/content/conductive-nitinol-wire accessed Apr. 8, 2020.

* cited by examiner

IMPACT RECOVERABLE ANTENNAS

FIELD

This disclosure relates generally to antennas and antenna systems, and more particularly to antennas having reconfigurable radiating elements.

BACKGROUND

Present day mobile platforms, such as aircraft (manned and unmanned, fixed-wing, rotary-wing, etc.), spacecraft, projectiles (e.g., missiles), hypersonic vehicles, watercraft, and even land vehicles, often use antenna systems for transmitting and receiving electromagnetic signals. These signals include, among other types of information, navigational instructions and sensed information. A radiating element of the antenna system is designed with a configuration that is tuned to a specific frequency or range of frequencies. Often, radiating elements of antenna systems undergo impact and thermal shocks that permanently deform the configuration or shape of the radiating element, especially when the mobile platform is launching, accelerating, or experiencing high-speed air friction. Unfortunately, these deformation events can negatively affect the effectiveness of the radiating element, such as by altering the frequency at which the radiating element was designed to operate.

SUMMARY

The subject matter of the present application provides example impact recoverable antennas that overcome the above-discussed shortcomings of prior art techniques. The subject matter of the present application has been developed in response to the present state of the art, and in particular, in response to shortcomings of antennas, and the conventional methods and systems for recovering a default configuration of an antenna following an impact event.

Disclosed herein is an impact recoverable antenna assembly. The antenna assembly includes, in certain examples, a conductive antenna element that is deformable from a default configuration to a deformed configuration in response to a deformation event. The conductive antenna element includes a first layer and a second layer that at least partially surrounds the first layer. In certain examples, one of the first layer or the second layer comprises a shape memory alloy configured to deform the conductive antenna element from the deformed configuration to the default configuration in response to a restoration event. The preceding subject matter of this paragraph characterizes example 1 of the present disclosure.

The antenna assembly, in certain examples, includes a reflective element coupled to the conductive antenna element. The preceding subject matter of this paragraph characterizes example 2 of the present disclosure, wherein example 2 also includes the subject matter according to example 1, above.

In certain examples, the antenna assembly includes a helical antenna having a first end portion, a second end portion, a diameter, a pitch, a length, and a plurality of turns. The first end couples to the reflective element. The preceding subject matter of this paragraph characterizes example 3 of the present disclosure, wherein example 3 also includes the subject matter according to example 2, above.

The helical antenna, certain examples is a first helical antenna, and the antenna assembly also includes a second helical antenna. The second helical antenna has a diameter that is less than the diameter of the first helical antenna. In certain examples, the second helical antenna is positioned within the first helical antenna. The preceding subject matter of this paragraph characterizes example 4 of the present disclosure, wherein example 4 also includes the subject matter according to example 3, above.

In certain examples, the deformation event modifies at least one of a diameter, a pitch, an orientation, or a length of the conductive antenna element. The restoration event includes one of a heating or cooling of the conductive antenna element. The preceding subject matter of this paragraph characterizes example 5 of the present disclosure, wherein example 5 also includes the subject matter according to any one of examples 1-4, above.

The first layer, in certain examples, is the shape memory alloy and the second layer comprises an electrically conductive plating that surrounds the shape memory alloy of the first layer. The preceding subject matter of this paragraph characterizes example 6 of the present disclosure, wherein example 6 also includes the subject matter of any of examples 1-5, above.

In certain examples, the first layer comprises an electrically conductive material, the second layer comprises the shape memory alloy, and the shape memory alloy of the second layer surrounds the first layer. The preceding subject matter of this paragraph characterizes example 7 of the present disclosure, wherein example 7 also includes the subject matter according to any of examples 1-5, above.

The shape memory alloy, in certain examples, is a nickel-titanium shape memory alloy. The preceding subject matter of this paragraph characterizes example 8 of the present disclosure, wherein example 8 also includes the subject matter according to any of examples 1-7, above.

Additionally, disclosed herein is a system for radio frequency processing, which can include radio frequency communication or radio frequency sensing. The system includes, in certain examples, a conductive antenna element comprising a first layer and a second layer that at least partially surrounds the first layer. The system also includes a temperature control system configured to increase or decrease a temperature of the conductive antenna element, and a controller operably coupled to the temperature control system. The controller is configured to detect deformation of the conductive antenna element from a default configuration to a deformed configuration, caused by a deformation event, and instruct the temperature control system to either increase or decrease the temperature of the conductive antenna element in response to detecting deformation of the conductive antenna element. The preceding subject matter of this paragraph characterizes example 9 of the present disclosure.

In certain examples, the first layer comprises a shape memory alloy configured to restore the conductive antenna element to the default configuration from the deformed configuration in response to the conductive antenna element being heated or cooled. The second layer comprises an electrically conductive plating. The preceding subject matter of this paragraph characterizes example 10 of the present disclosure, wherein example 10 also includes the subject matter according to example 9, above.

The first layer, in certain examples, comprises an electrically conductive material, and the second layer comprises a shape memory configured to restore the conductive antenna element to the default configuration from the deformed configuration in response to the conductive antenna element being heated or cooled. The preceding subject matter of this paragraph characterizes example 11 of the present disclosure, wherein example 11 also includes the subject matter according to example 9, above.

In certain examples, the controller includes a sensor configured to detect deformation of the conductive antenna element. The preceding subject matter of this paragraph characterizes example 12 of the present disclosure, wherein example 12 also includes the subject matter according to any of examples 9-11, above.

The system also includes, in certain examples, a reflective element coupled to the conductive antenna element. The preceding subject matter of this paragraph characterizes example 13 of the present disclosure, wherein example 13 also includes the subject matter according to any of examples 9-12, above.

In certain examples, the system also includes a radome that at least partially surrounds the conductive antenna element and the reflective element. The preceding subject matter of this paragraph characterizes example 14 of the present disclosure, wherein example 14 also includes the subject matter according to example 13, above.

The system also includes, in certain examples, a plurality of conductive antenna elements, each having a dielectric rod and a sensor disposed within a circumference of a respective conductive antenna element. The system also includes a radome comprising a plurality of compartments, wherein each one of the plurality of conductive antenna elements is positioned within a corresponding one of the plurality of compartments of the radome. The preceding subject matter of this paragraph characterizes example 15 of the present disclosure, wherein example 15 also includes the subject matter according to any of the examples 9-13, above.

In certain examples, the controller is configured to adjust a configuration of each one of the plurality of conductive antenna elements to modify at least one of: a radiation pattern formed by the plurality of conductive elements; a phasing by each of the plurality of conductive elements; and a tuning of each of the plurality of conductive elements to form a set of optimal frequencies of operation that simultaneously form desired beam patterns. The preceding subject matter of this paragraph characterizes example 16 of the present disclosure, wherein example 16 also includes the subject matter according to example 15, above.

Also disclosed is a method of restoring an impact recoverable antenna assembly to a default configuration. In certain examples, the method includes deforming a conductive antenna element from a default configuration to a deformed configuration, and restoring the conductive antenna element from the deformed configuration to the default configuration by modifying a temperature of a shape memory alloy of the conductive antenna element. The preceding subject matter of this paragraph characterizes example 17 of the present disclosure.

In certain examples, the step of deforming the conductive antenna element includes modifying the temperature of the shape memory alloy of the conductive antenna element. The preceding subject matter of this paragraph characterizes example 18 of the present disclosure, wherein example 18 also includes the subject matter according to example 17, above.

The step of restoring the conductive antenna element to the default configuration, in certain examples, includes tracking a history of strain and temperature and, based on the history and a predetermined hysteresis path, estimating a state of operation. The preceding subject matter of this paragraph characterizes example 19 of the present disclosure, wherein example 19 also includes the subject matter according to any of examples 17-18, above.

In certain examples, the deformed configuration comprises a modification of at least one of a diameter, a pitch, an orientation, or a length of the conductive antenna element. The preceding subject matter of this paragraph characterizes example 20 of the present disclosure, wherein example 20 also includes the subject matter according to any of examples 17-19, above.

The described features, structures, advantages, and/or characteristics of the subject matter of the present disclosure may be combined in any suitable manner in one or more examples, including embodiments and/or implementations. In the following description, numerous specific details are provided to impart a thorough understanding of examples of the subject matter of the present disclosure. One skilled in the relevant art will recognize that the subject matter of the present disclosure may be practiced without one or more of the specific features, details, components, materials, and/or methods of a particular example, embodiment, or implementation. In other instances, additional features and advantages may be recognized in certain examples, embodiments, and/or implementations that may not be present in all examples, embodiments, or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific examples that are illustrated in the appended drawings. Understanding that these drawings depict only typical examples of the subject matter, they are not therefore to be considered to be limiting of its scope. The subject matter will be described and explained with additional specificity and detail through the use of the drawings, in which.

DETAILED DESCRIPTION

Reference throughout this specification to "one example," "an example," or similar language means that a particular feature, structure, or characteristic described in connection with the example is included in at least one example of the present disclosure. Appearances of the phrases "in one example," "in an example," and similar language throughout this specification may, but do not necessarily, all refer to the same example. Similarly, the use of the term "implementation" means an implementation having a particular feature, structure, or characteristic described in connection with one or more examples of the present disclosure, however, absent an express correlation to indicate otherwise, an implementation may be associated with one or more examples.

Figure 1:
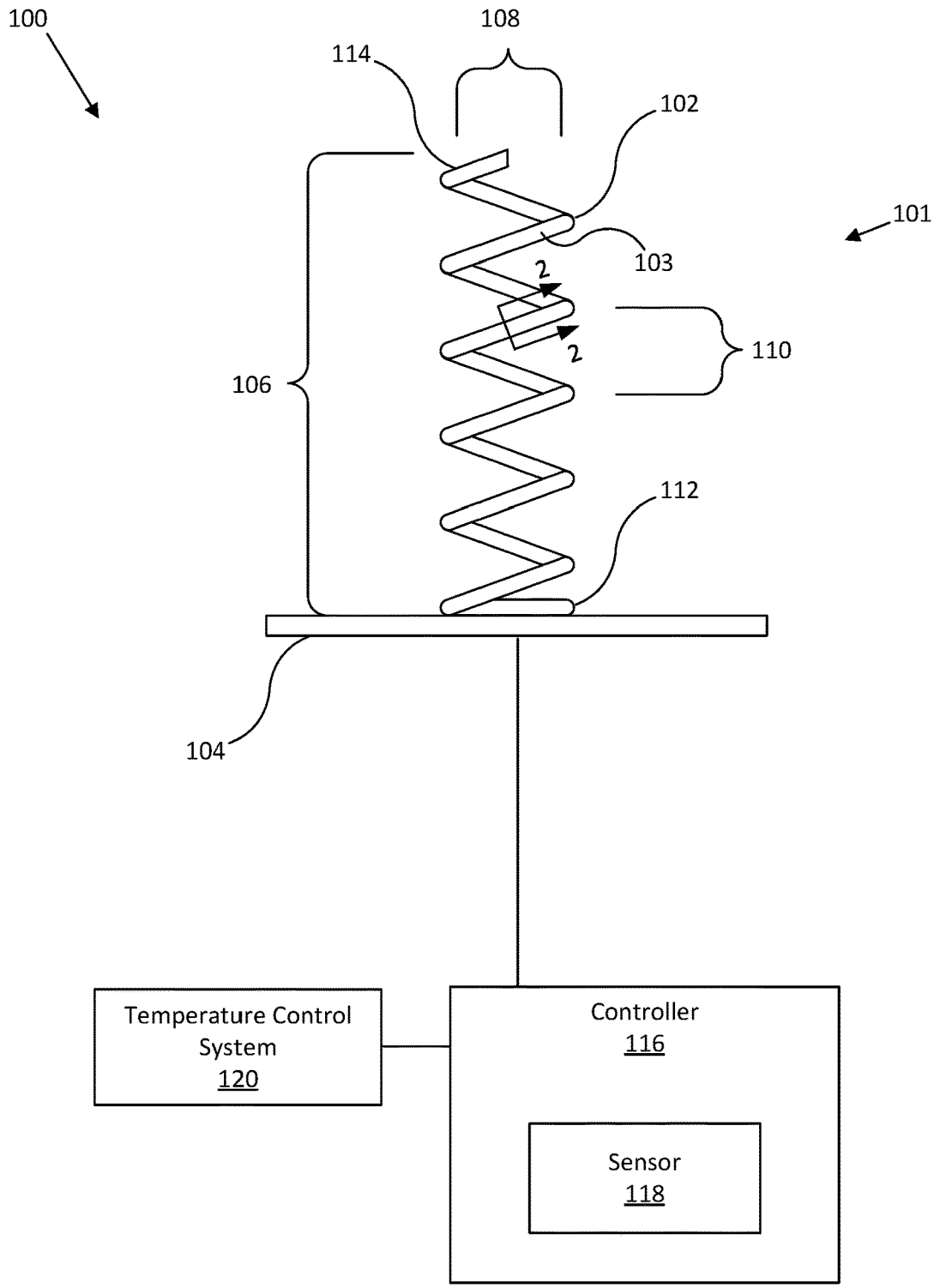
FIG. 1 is a schematic block diagram illustrating a system for an impact recoverable antenna assembly, according to examples of the subject disclosure.

Referring to FIG. 1, one example of a system 100 for an impact recoverable antenna assembly 101 for transceiving electromagnetic waves is shown. In certain examples, the antenna assembly 101 is a helical antenna 103 that has a conductive antenna element 102 (i.e., radiating element) and a reflective element 104. The reflective element 104, in some examples, is a frequency-dependent reflector. In certain examples, the reflective element 104 is a plurality of spectrally dependent reflectors and ground planes. For example, the ground plane is a wire net that functions as a perfect ground plane at lower frequencies but is semi-transparent at higher frequencies. Dimensional characteristics of the conductive antenna element 102 are modifiable to configure the antenna assembly 101 for different modes of operation. The modes of operation include, for example, normal mode, distorted mode, inverse mode, axial mode, and higher order mode.

The dimensional characteristics, in certain examples, include a length 106, a diameter 108, and a pitch 110. "Pitch," as used herein, refers to the spacing between turns or coils of the conductive antenna element 102. Other definable characteristics of the conductive antenna element 102 include a number of turns and pitch angle. In certain examples, the conductive antenna element 102 has a variable pitch design to enable processing (e.g., communications or sensing (such as for radar applications or remote sensing platforms)) on different electromagnetic spectrums. In normal mode, the diameter 108 and pitch 110 of the conductive antenna element 102 is small compared to a wavelength of the electromagnetic signal. In axial mode, the diameter 108 and pitch 110 are comparable to a wavelength.

The conductive antenna element 102, in certain examples, is coupled at a first end portion 112 to the reflective element 104. A second end portion 114 of the conductive antenna element 102 is non-fixed, cantilevered, or free floating. However, in certain other examples, the second end portion 114 is coupled to a support structure.

The system 100, in certain examples, includes a controller 116, a sensor 118, and a temperature control system 120. The controller 116 is configured to adaptively control the configuration (i.e., dimensional characteristics and orientation) of the conductive antenna element 102 by identifying, via the sensor 118, the current configuration of the conductive antenna element 102 and, if necessary, controlling the temperature control system 120 to modify a temperature of the conductive antenna element 102. In certain examples, the controller 116 maintains a history of deformation, including a strain history (e.g., the extent of deformation) and a temperature history experienced by the conductive antenna element 102.

As will be described in greater detail below with reference to FIG. 2, the conductive antenna element 102 includes a shape-memory alloy component that is responsive to changes in temperature. Generally, a shape-memory alloy is in a martensite low-temperature phase with a cubic or monoclinic crystal structure, which begins to transform into an austenite high-temperature phase with a cubic crystal upon reaching a first austenite threshold temperature. The transformation from the martensite low-temperature phase to the austenite high-temperature phase is completed upon reaching a second austenite threshold temperature higher than the first austenite threshold temperature. From the austenite high-temperature phase, the transformation to the martensite low-temperature phase is initiated and completed after the temperature of the shape-memory alloy is cooled below first and second martensite threshold temperatures, respectively. As the shape-memory alloy transforms between the austenite high-temperature phase and martensite low-temperature phase, the shape-memory alloy physically deforms between a first shape and a second shape.

The shape-memory alloy can be configured to deform between a first or default shape and a second or deformed shape based on the temperature of the shape-memory alloy. In certain examples, the shape-memory alloy is configured with multiple temperature-dependent default shapes. As is known, an amount of deformation of the shape-memory alloy is not only temperature-dependent, but also depends on whether the transition is a "heating transition" or a "cooling transition," which gives rise to a hysteresis path. The hysteresis path is a mapping of temperatures to deformation dimensions (e.g., lengths) in both the heating transition and the cooling transition. The controller 116, in certain examples is configured with the hysteresis path and is able to modify the configuration of the conductive antenna element 102 based on the history and the hysteresis path.

The shape-memory alloys are special metallic materials that are capable of returning to a previously defined shape (e.g., original or default shape) after being deformed. Generally, a shape-memory alloy can be trained to deform in a particular manner from the original shape into the deformed state when a temperature of the shape-memory alloy increases beyond an upper temperature threshold and deform in the same manner back to the original shape from the deformed state when the temperature of the shape-memory alloy decreases below a lower temperature threshold. In some examples, the shape-memory alloy of the conductive antenna element 102 is at least one of various nickel-titanium alloys and copper-based alloys, among others. The composition of the shape-memory alloy can be selected to provide a desired range of deformation as well as desired upper and lower threshold temperatures associated with respective phase changes of the alloy.

Accordingly, the controller 116 modifies the configuration of the conductive antenna element 102 by causing the temperature control system 120 to either increase or decrease the temperature of the conductive antenna element 102. In certain examples, the temperature control system 120 utilizes a resistive heating wire to increase the temperature of the conductive antenna element 102. Other examples of devices suitable for use by the temperature control system 120 include, but are not limited to, heat pumps that provide both heating and cooling, infrared heaters, other electromagnetic radiative heaters, heat pipes, heat sinks, etc. Stated differently, the temperature control system 120 uses any device capable of conduction, convection, or radiation to alter the temperature of the conductive antenna element 102. In certain examples, the controller 116 sends an "activation signal" to the temperature control system 120 signaling that the conductive antenna element 102 is to return to a default configuration. In certain examples, the activation signal is a heat signal or a voltage that causes an increase in the internal temperature of the conductive antenna element 102.

The sensor 118, in certain examples, is an optical sensor that detects the configuration (e.g., length 106, diameter 108, pitch 110, and orientation with respect to the reflective element 104) of the conductive antenna element 102. The sensor 118 communicates the configuration information with the controller 116. The controller 116, in certain examples, determines whether a deformation event has occurred to change the default configuration of the conductive antenna element 102, and if the determination is positive the controller 116 instructs the temperature control system 120 to modify the temperature of the conductive antenna element 102 such that the shape-memory alloy returns to the default configuration.

Figure 2:
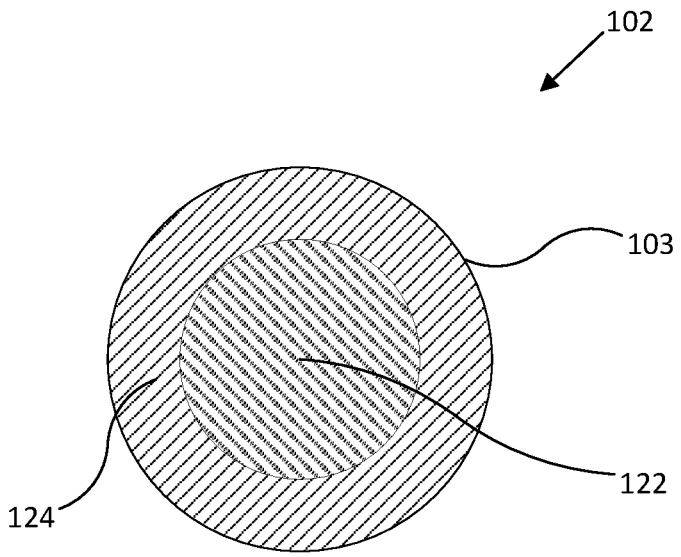
FIG. 2 is a cross-section of a conductive antenna element, taken along the line 2-2 of FIG. 1, according to examples of the subject disclosure.

Referring now to FIG. 2, according to some examples, the conductive antenna element 102 includes a first layer 122 and a second layer 124 that at least partially surrounds the first layer 122. In one example, as illustrated in FIG. 2, the conductive antenna element 102 is a helical antenna 103 and the first layer 122 is entirely surrounded by the second layer 124. Because the second layer 124 at least partially surrounds the first layer 122, the second layer 124 is considered to be a cladding or a coating for the first layer 122. In certain examples, the first layer 122 is a copper wire, although other conductive materials may be utilized. The second layer 124, in certain examples, is a shape-memory alloy (sometimes referred to as a smart memory alloy as presented above) configured to alter the configuration of the conductive antenna element 102. Although depicted as a round wire, in some examples, the first layer 122 has a relatively flat or non-round shape that corresponds with a flat or other non-round shaped antenna element 102. Similarly, although depicted as having an annular shape, in certain examples, the second layer 124 has a non-circular or non-annular shape corresponding with the non-round shape of the first layer 122. The shape-memory alloy is a material that returns to a "learned" or default configuration by the application of heat after being plastically deformed at a lower temperature. In certain examples, the second layer 124 fully surrounds the first layer 122. The second layer 124, in some examples, partially surrounds the first layer 122.

Beneficially, the use of a shape-memory alloy allows for impact recoverable antenna elements as well as controllable and reconfigurable antenna elements. In other words, the examples of the subject disclosure enable a conductive antenna element 102 that recovers, passively or actively, a default configuration after a deformation event. For example, a hypersonic vehicle, such as a missile, that launches with high-g acceleration forces can deform the conductive antenna element 102. Another example of a deformation event is a direct impact of the conductive antenna element 102 with an object. High-speed air resistance will heat up the conductive antenna element 102 and cause the shape-memory alloy to return to a default configuration (e.g., default orientation with respect to the reflective element 104, default length 106, and default pitch 110). Another example of a deformation event is the controller 116 causing the deformation by changing the temperature of the conductive antenna element 102. The controller 116 also actively restores the conductive antenna element 102 to the default configuration by instructing the temperature control system 120 to modify the temperature of the conductive antenna element.

In certain examples, the first layer 122 is the shape-memory alloy and the second layer 124 is an electrically conductive plating, or coating, of a material such as, but not limited to, copper, gold, silver, platinum, etc. In either example, whether the shape-memory alloy is the first layer 122 or the second layer 124, the first layer 122 and the second layer 124 are bonded by extrusion, pressing, rolling, or other suitable processes.

Figure 3A:
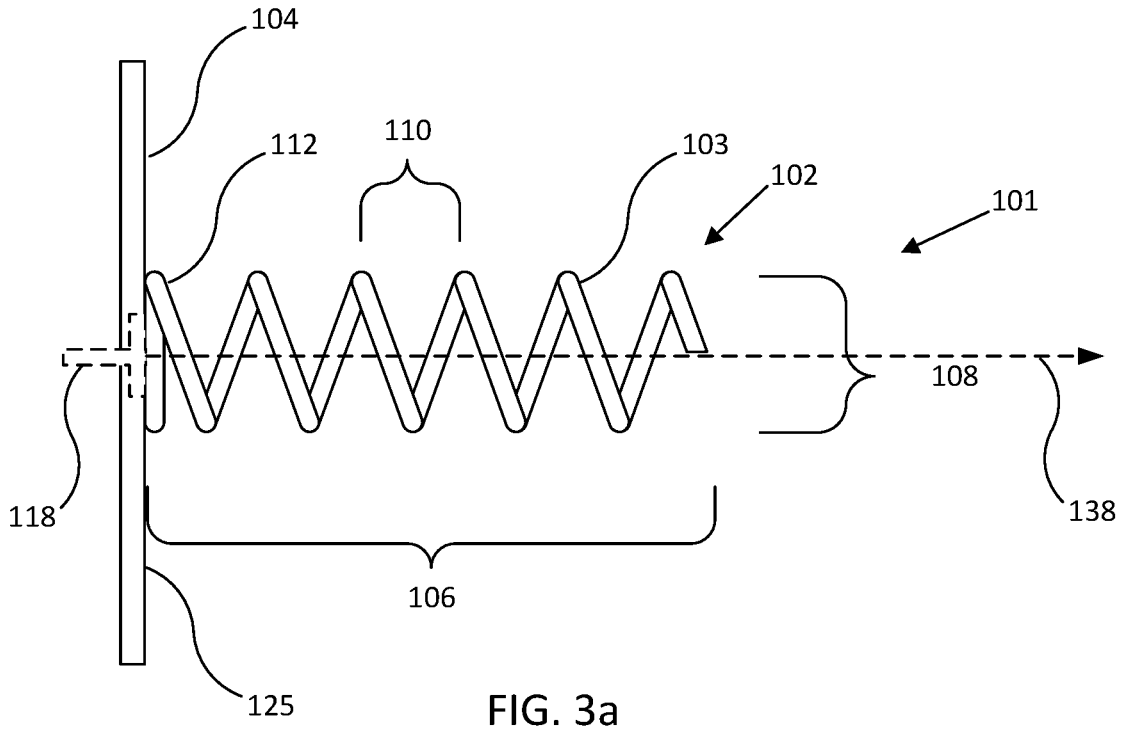
FIG. 3*a* is a side view of a conductive antenna element, in a first configuration, according to examples of the subject disclosure.
Figure 3B:
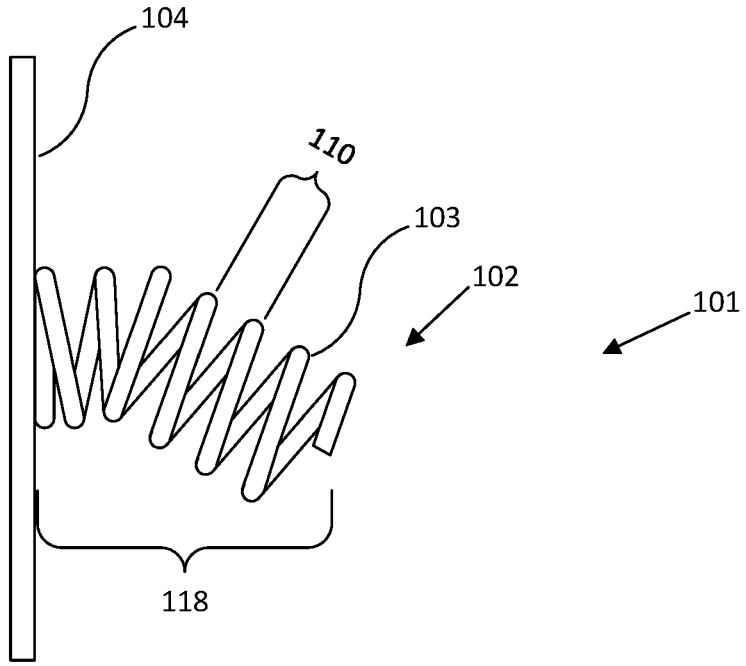
FIG. 3*b* is a side view of the conductive antenna element of FIG. 3*a*, in a second configuration, according to examples of the subject disclosure.

FIGS. 3*a* and 3*b* are side-view diagrams illustrating a first configuration and a second configuration of a conductive antenna element 102, according to examples of the subject disclosure. The antenna assembly 101, as described above, includes the conductive antenna element 102 and the reflective element 104. The conductive antenna element 102, in certain examples, is a helical antenna 103. The helical antenna 103 has a first or default configuration that includes a default length 106, a default diameter 108, a default pitch 110, and a default orientation with respect to the reflective element 104. In the depicted example, the helical antenna 103 extends outward orthogonally from the reflective element 104. The reflective element 104, in certain examples, is a substantially planar member having a surface 125 for coupling to the first end portion 112 of the helical antenna 103.

Also shown in FIG. 3*a* is the sensor 118, according to examples of the subject disclosure. In certain examples the sensor 118, is an optical or infrared sensor that detects the configuration (e.g., length 106, diameter 108, pitch 110, and orientation with respect to the reflective element 104) of the conductive antenna element 102. The sensor 118 communicates the configuration information with the controller 116. The controller 116, in certain examples, determines whether a deformation event has occurred based on the configuration information received from the sensor 118. The sensor 118, in certain examples, is positioned at a base of the helical antenna 103 to have a view through a bore defined by the circumference of the helical antenna, as depicted by line 138.

FIG. 3*b* depicts a second configuration, or deformed configuration, of the antenna assembly 101. The helical antenna 103, in certain situations, experiences a deformation event. Examples of deformation events include, but are not limited to, direct impacts with an object, high acceleration events that cause the helical antenna 103 to compress, or controlled deformations via the controller 116. A deformation event is any event that modifies a physical characteristic of the helical antenna 103 (e.g., length 106, diameter 108, pitch 110, etc.) or modifies the orientation of the helical antenna 103 with respect to the reflective element 104. FIG. 3*b* depicts a deformation event that has modified both physical characteristics and orientation. Beneficially, the shape-memory alloy component of the helical antenna 103 is configurable to return the helical antenna 103 to the first configuration, as discussed above, by modifying the temperature of the helical antenna 103.

A deformation event, in certain examples, causes a modification of one or more of the physical characteristics of the helical antenna 103. For example, the deformation event changes the pitch 110 and orientation of the helical antenna 103. Altering the pitch 110 results potentially in a change of operating mode (e.g., from axial mode to normal mode) and/or a change of operating frequency.

Figure 4:
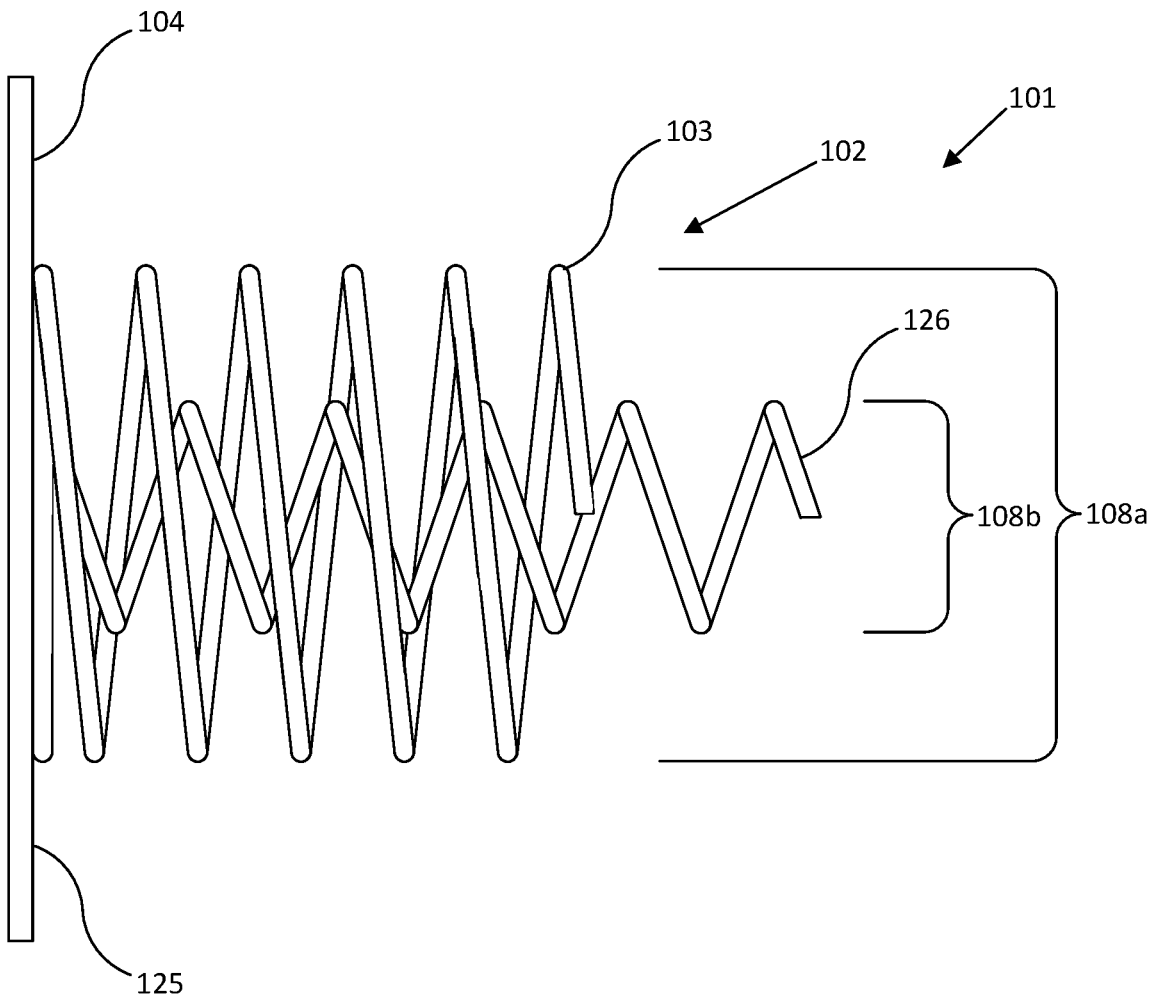
FIG. 4 is a side view of a multi-element antenna assembly, according to examples of the subject disclosure.

FIG. 4 is a side view diagram of a multi-element antenna assembly 101, according to examples of the subject disclosure. In certain examples, the antenna assembly 101 includes two or more conductive antenna elements. The first conductive antenna element 102 is a helical antenna 103 with a diameter 108*a* that is larger than a diameter 108*b* of a second conductive antenna element 126. As the second conductive antenna element 126 has a diameter 108*b* that is less than the diameter 108*a* of the first conductive antenna element 102, the second conductive antenna element 126 is, in certain examples, disposed within a circumference of the first conductive antenna element 102. Both the first conductive antenna element 102 and the second conductive antenna element 126, in certain examples, include a shape-memory alloy component.

The first conductive antenna element 102 and the second conductive antenna element 126 are independently configurable via the controller 116. For example, different temperatures are applied to the individual conductive antenna elements 102, 126 to achieve different deformations. This beneficially allows for a reconfigurable antenna assembly 101 that is adjustable in different bands. Multi-frequency communications or sensing and multi-mode operations are possible and dynamically adjustable via the controller 116.

Figure 5A:
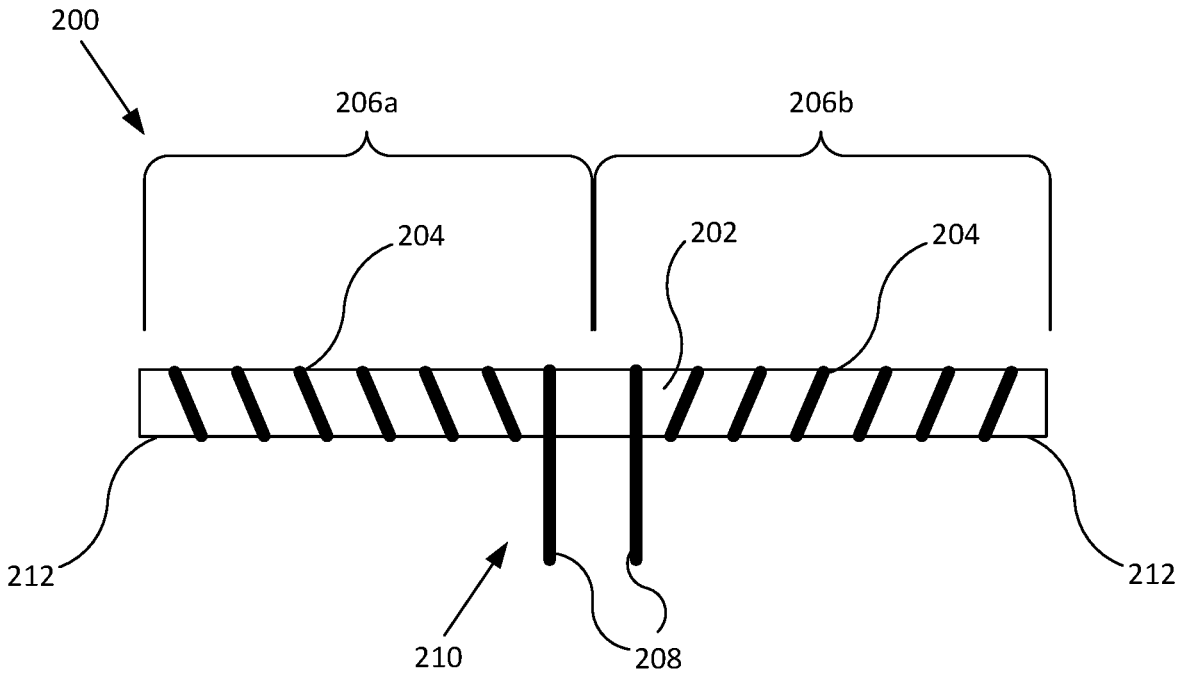
FIG. 5*a* is a side view of a dipole antenna, according to one example of the subject disclosure.
Figure 5B:
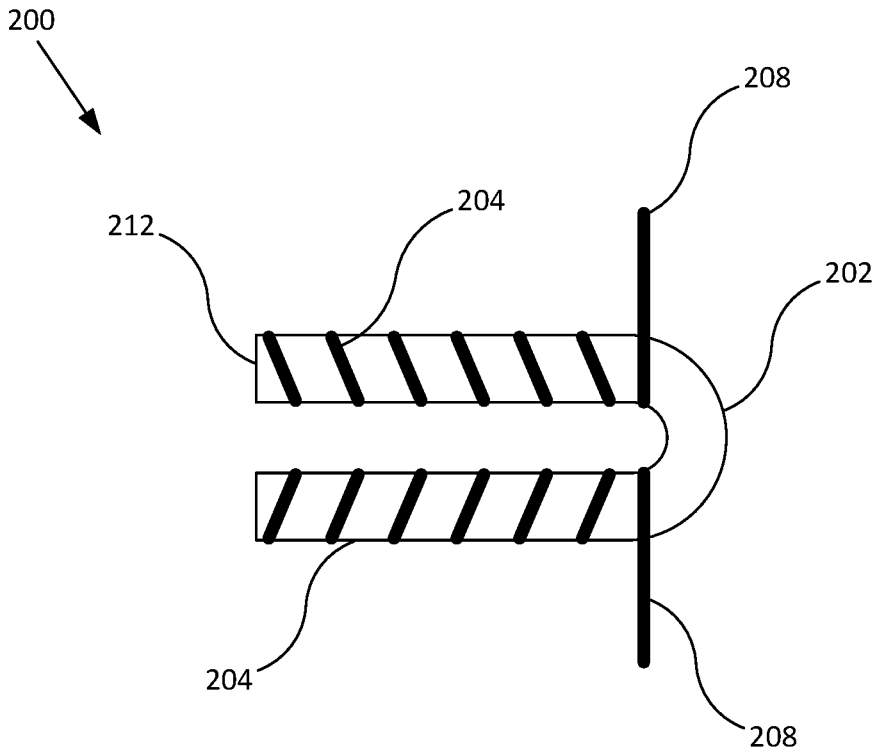
FIG. 5*b* is a side view of a dipole antenna, according to another example of the subject disclosure.

FIGS. 5*a* and 5*b* are side view diagrams of a dipole antenna 200, according to examples of the subject disclosure. As is known, a dipole antenna typically has two identical, bilaterally symmetrical conductive elements such as metal wires or rods connected to a feed line. A driving current is applied, or for receiving antennas the output of the signal is taken, between the two halves 206 (referred to collectively as "halves 206," and individually as "half 206*a*" or "half 206*b*") of the antenna. In certain examples, the dipole antenna 200 includes a first layer 202 formed of a shape-memory alloy and a conductive second layer 204 that at least partially surrounds the first layer 202.

In certain examples, the two halves 206, in a normal mode of operation, are oriented end to end on the same axis with feed lines 208 electrically coupled to the conductive second layer 204. The conductive second layer 204 spirals, in a helical fashion, around the first layer 202 from a central region 210 towards each end 212 of the first layer 202. The direction of the spiral second layer 204 determines a polarization direction. In the depicted example, the left half 206*a* of FIG. 5*a* has a right-circular polarization and the right half 206*b* has a left-circular polarization. In certain examples, the polarization direction of the dipole antenna 200 is adjustable by sending an activation signal (e.g., heat or voltage) to the shape-memory alloy first layer 202.

The first layer 202, in some examples, is configured to transition from a linear rod, as depicted in FIG. 5*a*, to a U-shape or V-shape as depicted in FIG. 5*b*. This beneficially allows for the controller 116 to manipulate many operating parameters of the dipole antenna 200, including but not limited to, radiation direction, operating mode, antenna efficiency, etc. In certain examples, the controller 116 controls the orientation (e.g., linear or U-shape) of the dipole antenna 200 to prevent radiation. This is beneficial in situations where radio transmissions are not desirable.

Figure 6A:
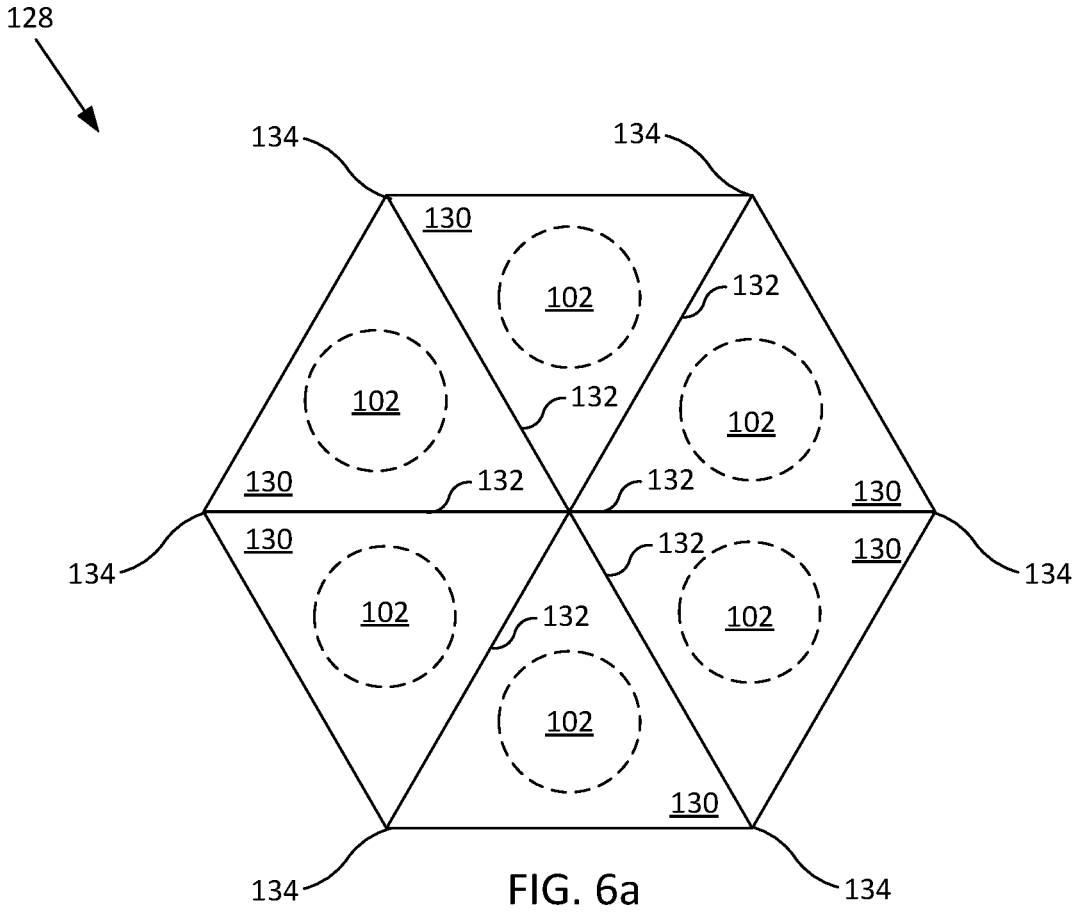
FIG. 6*a* is a top plan view of a multi-element antenna system, according to examples of the subject disclosure.
Figure 6B:
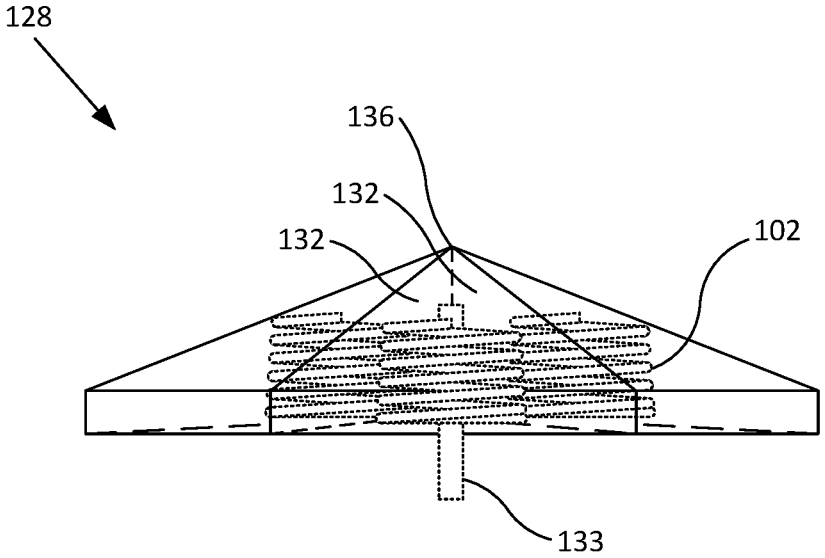
FIG. 6*b* is a side elevation view of the multi-element antenna system of FIG. 6*a*, according to examples of the subject disclosure.

FIGS. 6*a* and 6*b* are views of a multi-element antenna system disposed within the radome 128, according to examples of the subject disclosure. The multi-element antenna system includes two or more conductive antenna elements 102 that are controllable to beamform without an external mechanical device. In other words, the conductive antenna elements 102, with either a shape-memory alloy first layer 122 or second layer 124, are configurable to sweep or direct the radiation pattern in a specific direction. In certain examples, the controller 116 is configured to adjust a configuration of each of the conductive antenna elements 102 to, beneficially, modify a radiation pattern formed by the conductive antenna elements 102, modify a phasing by each of the plurality of conductive elements 102, and modify a tuning of each of the plurality of conductive elements 102 to form a set of optimal frequencies of operation that simultaneously form desired beam patterns.

FIG. 6*a* depicts a top view of a radome 128 that includes one or more compartments 130 that are internal to the radome 128. FIG. 6*b* is a side view diagram of the radome 128 and some of the internal conductive antenna elements 102 disposed within. In certain examples, the radome 128 is a hexagonal pyramid having six internal compartments 130. Although a hexagonal pyramid is depicted and described, any pyramid (e.g., triangular, pentagonal, octagonal, etc.), cone, sphere, etc. is suitable for use as the radome 128. Each compartment 130, in certain examples, is separated from an adjacent compartment 130 by a membrane 132 or divider. The membrane 132 is configured to prevent adjacent conductive antenna elements 102 from getting tangled during a high-g acceleration event likely to cause deformation. The membranes 132, in certain examples, extend from corner 134 of the polygonal pyramid base to an apex 136 of the radome 128. In certain examples, a dielectric rod 133 also is provided to prevent antenna element 102 entanglement. The dielectric rod 133 is positioned within the circumference of a helical antenna element 102 to guide the helical antenna element 102 and prevent helix entanglement. Although FIG. 6*b* depicts a single dielectric rod 133, each antenna element 102, in certain examples, includes a dielectric rod 133.

Figure 7:
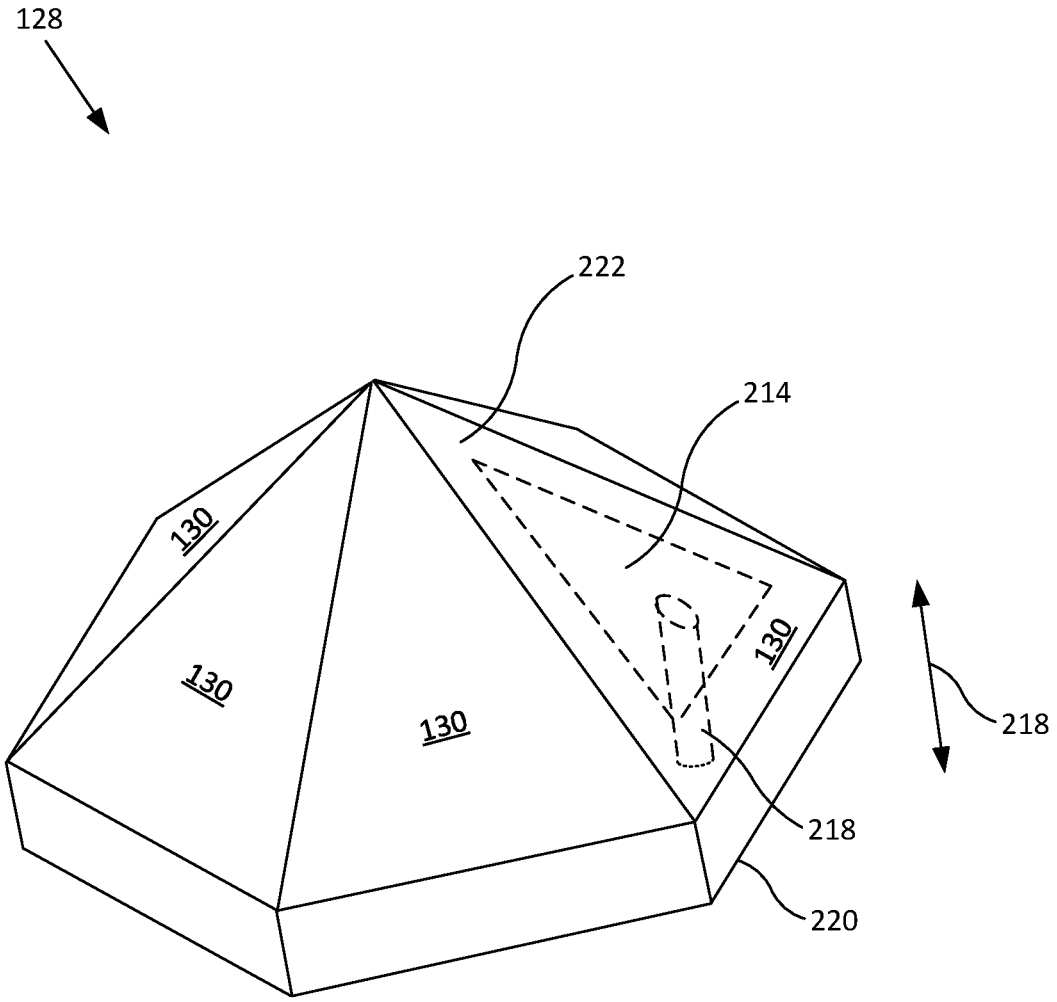
FIG. 7 is a perspective view of a radome, according to examples of the subject disclosure.

FIG. 7 is a perspective view diagram of the radome 128, according to examples of the subject disclosure. The depicted example illustrates a conductive antenna element having a wedge-shaped radiating element 214 electrically coupled with a stem 216 that is configured to raise and lower the wedge-shaped radiating element 214 in a direction depicted by arrow 218. Although a single wedge-shaped radiating element 214 is depicted, each compartment 130, in certain examples, has a wedge-shaped radiating element 214. The wedge-shaped radiating element 214 is sized and oriented to conform to a lateral face 222 that corresponds to each compartment 130.

The stem 216, in certain examples, is made of a shape-memory alloy and controllable to extend the wedge-shaped radiating element 214 from a stored position adjacent a base 220, to an extended position adjacent a lateral face 222 of the radome 128. This beneficially allows for the wedge-shaped radiating elements 214 to be stored during a launch or high acceleration event, and extended otherwise. In certain examples, the wedge-shaped radiating element 214 and the stem 216 are unitary and formed of a first layer and a second layer. As described above, one of either the first layer or the second layer of the wedge-shaped radiating element 214 is a shape-memory alloy.

Figure 8:
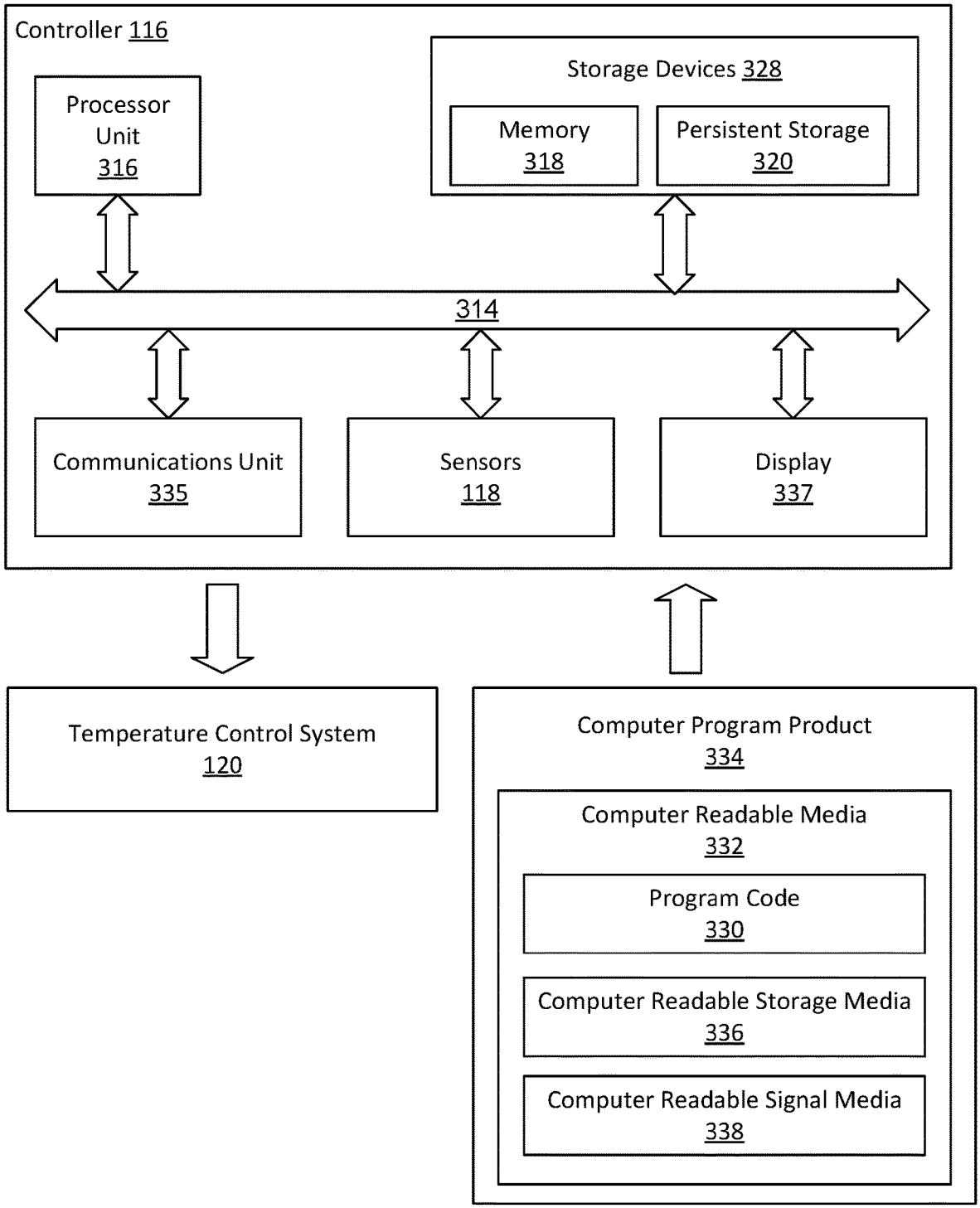
FIG. 8 is a schematic block diagram illustrating a controller, according to examples of the subject disclosure.

FIG. 8 is a schematic block diagram illustrating a controller 116, according to examples of the subject disclosure. The controller 116 is an example of a computing device, which, in some examples, is used to implement one or more components of examples of the disclosure, and in which computer usable program code or instructions implementing the processes can be located for the illustrative examples. In this illustrative example, the controller includes a communications fabric 314, which provides communications between a processor unit 316, memory 318, sensors 118 (such as temperature sensors and optical sensors), persistent storage 320, a communications unit 335, and a display 337. The sensors 118, in certain examples, are configured to detect a temperature of ambient air, a temperature of a conductive antenna element 102, a change in size, shape, or orientation of the conductive antenna element 102, a change in operating efficiency, etc.

The processor unit 316 serves to execute instructions for software that are loaded into memory 318 in some examples. In one example, the processor unit 316 is a set of one or more processors or can be a multi-processor core, depending on the particular implementation. Further, the processor unit 316 is implemented using one or more heterogeneous processor systems, in which a main processor is present with secondary processors on a single chip, according to some examples. As another illustrative example, the processor unit 316 is a symmetric multi-processor system containing multiple processors of the same type.

Memory 318 and persistent storage 320 are examples of storage devices 328. A storage device is any piece of hardware that is capable of storing information, such as, for example, without limitation, data, program code in functional form, and/or other suitable information either on a temporary basis and/or a permanent basis. Memory 318, in these examples, is a random-access memory, or any other suitable volatile or non-volatile storage device. Persistent storage 320 takes various forms, depending on the particular implementation. In one example, persistent storage 320 contains one or more components or devices. In an example, persistent storage 320 is a hard drive, a flash memory, a rewritable optical disk, a rewritable magnetic tape, or some combination of the above. The media used by persistent storage 320 is removable in some examples. For example, a removable hard drive is used for persistent storage 320 in various implementations.

The communications unit 335, in these examples, provides for communication with other data processing systems or devices. In these examples, the communications unit 335 is a network interface card. The communications unit 335 provides communications through the use of either, or both, physical and wireless communications links. In some examples, the communication unit 335 also provides a connection for user input through a keyboard, a mouse, and/or some other suitable input device. Further, the input/output unit sends output to a printer or receive input from any other peripheral device in various examples. The display 337 provides a mechanism to display information to a user.

In some examples, instructions for the operating system, applications, and/or programs are located in the storage devices 328, which are in communication with the processor unit 316 through the communications fabric 314. In these illustrative examples, the instructions are in a functional form on persistent storage 320. These instructions are loaded into memory 318 for execution by the processor unit 316 in some examples. In certain examples, the processes of the different examples are performed by the processor unit 316 using computer implemented instructions, which is located in a memory, such as the memory 318.

These instructions are referred to as program code, computer usable program code, or computer readable program code that can be read and executed by a processor in the processor unit 316. The program code, in the different examples, is embodied on different physical or computer readable storage media, such as the memory 318 or the persistent storage 320.

Program code 330 is located in a functional form on computer readable media 332 that is selectively removable and can be loaded onto or transferred to the controller 116 for execution by the processor unit 316. In some examples, the program code also contains the curing plan discussed above. The program code 330 and computer readable media 332 form computer program product 334. In one example, the computer readable media 332 is a computer readable storage media 336 or a computer readable signal media 338. The computer readable storage media 336 includes, in one example, an optical or magnetic disc that is inserted or placed into a drive or other device that is part of the persistent storage 320 for transfer onto a storage device, such as a hard drive, that is part of the persistent storage 320. In other examples, the computer readable storage media 336 also takes the form of a persistent storage, such as a hard drive, a thumb drive, or a flash memory that is connected to the controller 116. In some instances, the computer readable storage media 336 is not removable from the controller 116.

Alternatively, the program code 330 is transferred to the controller 116 using computer readable signal media 338. Computer readable signal media 338 is, as one example, a propagated data signal containing program code 330. For example, the computer readable signal media 338 is an electromagnetic signal, an optical signal, and/or any other suitable type of signal in one example. These signals are transmitted over communications links, such as wireless communication links, an optical fiber cable, a coaxial cable, a wire, and/or any other suitable type of communications link. In other words, the communications link and/or the connection is physical or wireless in the illustrative examples. The computer readable media also takes the form of non-tangible media, such as communications links or wireless transmissions containing the program code, in some examples.

In some illustrative examples, the program code 330 is downloaded over a network to the persistent storage 320 from another device or data processing system through the computer readable signal media 338 for use within the controller 116. In one instance, program code stored in a computer readable storage media in a server data processing system is downloaded over a network from a server to the controller 116. According to various examples, the system providing the program code 330 is a server computer, a client computer, or some other device capable of storing and transmitting program code 330.

The different components illustrated for the controller 116 are not meant to provide physical or architectural limitations to the manner in which different examples can be implemented. The different illustrative examples can be implemented in a controller including components in addition to and/or in place of those illustrated for the controller 116. Other components shown in FIG. 8 can be varied from the illustrative examples shown. The different examples can be implemented using any hardware device or system capable of executing program code. For example, a storage device in the controller 116 is any hardware apparatus that can store data. The memory 318, persistent storage 320, and the computer readable media 332 are examples of storage devices in a tangible form.

In another example, a bus system is used to implement communications fabric 314 and can be comprised of one or more buses, such as a system bus or an input/output bus. Of course, in some examples, the bus system is implemented using any suitable type of architecture that provides for a transfer of data between different components or devices attached to the bus system. In addition examples, a communications unit includes one or more devices used to transmit and receive data, such as a modem or a network adapter. Further, a memory is, for example, the memory 318 or a cache such as found in an interface and memory controller hub that can be present in the communications fabric 314.

Computer program code for carrying out operations for aspects of the subject disclosure can be written in any combination of one or more programming languages, including an object-oriented programming language such as Java, Smalltalk, C++ or the like and conventional procedural programming languages, such as the "C" programming language or similar programming languages. The program code can execute entirely on the user's computer, partly on the user's computer, as a stand-alone software package, partly on the user's computer and partly on a remote computer or entirely on the remote computer or server. In the latter scenario, the remote computer can be connected to the user's computer through any type of network, including a local area network (LAN) or a wide area network (WAN), or the connection can be made to an external computer (for example, through the Internet using an Internet Service Provider).

These computer program instructions can also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions can also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Figure 9:
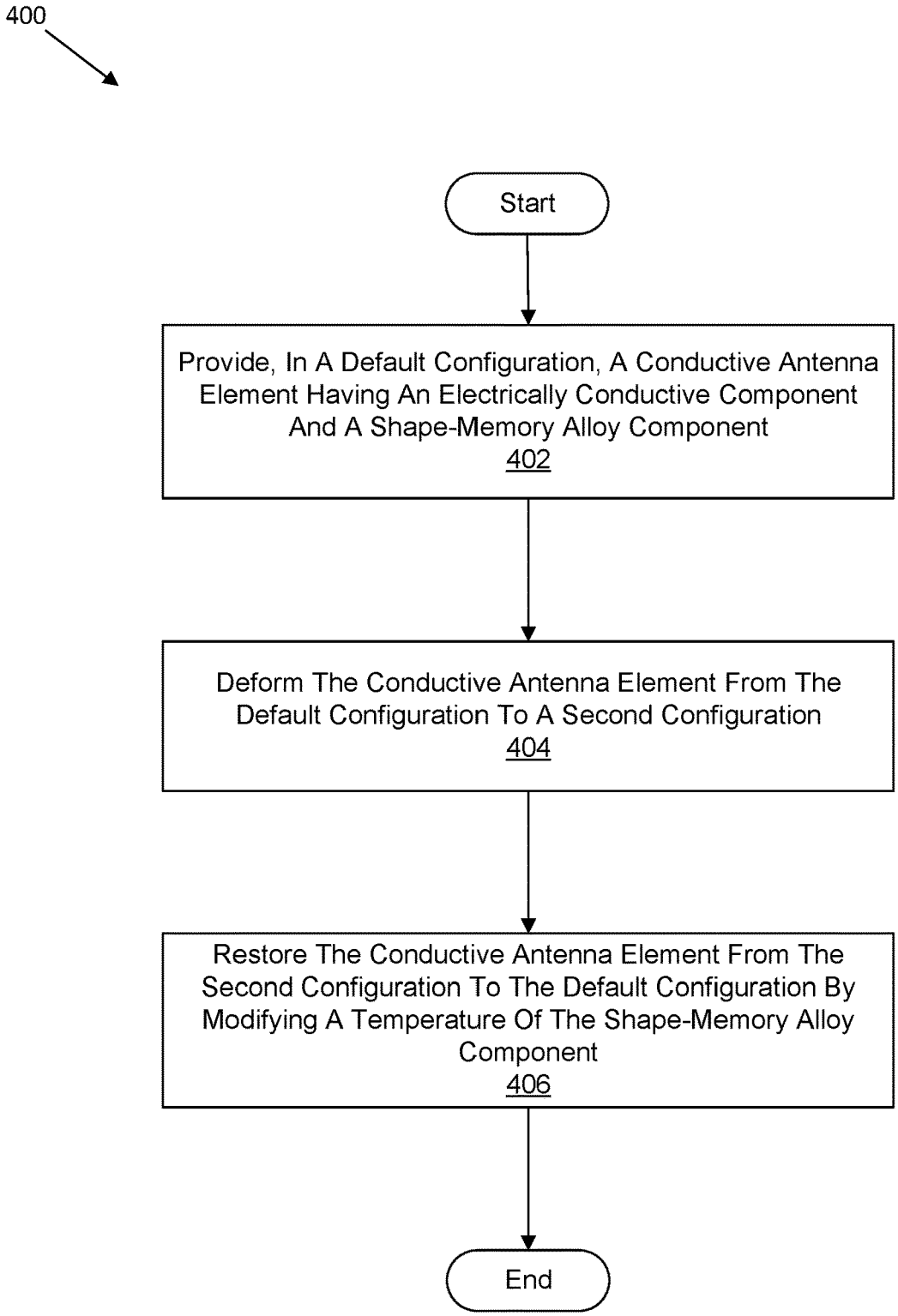
FIG. 9 is a flowchart diagram illustrating a method of restoring a conductive antenna element to a default configuration, according to examples of the subject disclosure.

FIG. 9 is a flowchart diagram illustrating a method 400 for restoring a conductive antenna element 102 to a default configuration, according to examples of the subject disclosure. The method 400 includes, in certain examples, providing, at block 402, a conductive antenna element 102 having an electrically conductive component and a shape-memory alloy component. For example, the conductive antenna element 102 has a shape-memory alloy first layer and a conductive second layer, or alternatively, a conductive first layer and a shape-memory alloy second layer.

The method 400 also includes, at block 404, deforming the conductive antenna element 102 from a default configuration to a second or deformed configuration. In certain examples, the conductive antenna element 102 experiences a deformation event caused by, for example, a high-g acceleration of a vehicle or a physical impact from an object. In certain examples, the conductive antenna element 102 experiences a deformation event caused by the controller 116.

The method 400, at block 406, includes restoring the conductive antenna element 102 from the deformed configuration to the default configuration in response to a restoration event by modifying a temperature of the shape-memory alloy component of the conductive antenna element 102. The restoration event, in certain examples, includes an instruction from the controller 116 to the temperature control system 120 that requests a change in temperature of the shape-memory alloy component. In certain examples, the restoration event is the conductive antenna element 102 reaching a temperature threshold that matches a desired operating temperature. In certain examples, modifying the shape-memory component of the conductive antennae element 102 includes applying heat via conduction, convection, or radiation.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one example of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described examples are to be considered in all respects only as illustrative and not restrictive. All changes which come within the meaning and range of equivalency of the claims are to be embraced within their scope.

What is claimed is:

1. An antenna assembly for transceiving electromagnetic waves, the antenna assembly comprising:

a conductive antenna element that is deformable from a default configuration to a deformed configuration in response to a deformation event, wherein:

the conductive antenna element comprises a first layer and a second layer that at least partially surrounds the first layer; and one of the first layer or the second layer comprises a shape memory alloy configured to deform the conductive antenna element from the deformed configuration to the default configuration in response to a restoration event.

2. The antenna assembly of claim 1, further comprising a reflective element coupled to the conductive antenna element.

3. The antenna assembly of claim 2, wherein:

the conductive antenna element comprises a helical antenna having a first end portion, a second end portion, a diameter, a pitch, a length, and a plurality of turns; and the first end couples to the reflective element.

4. The antenna assembly of claim 3, wherein:

the helical antenna is a first helical antenna;

the conductive antenna element further comprises a second helical antenna having a diameter that is less than the diameter of the first helical antenna; and the second helical antenna is positioned within the first helical antenna.

5. The antenna assembly of claim 1, wherein:

the deformation event modifies at least one of a diameter, a pitch, an orientation, or a length of the conductive antenna element; and the restoration event comprises one of a heating or cooling of the conductive antenna element.

6. The antenna assembly of claim 1, wherein:

the first layer comprises the shape memory alloy; and the second layer comprises an electrically conductive plating that surrounds the shape memory alloy of the first layer.

7. The antenna assembly of claim 1, wherein:

the first layer comprises an electrically conductive material;

the second layer comprises the shape memory alloy; and the shape memory alloy of the second layer surrounds the first layer.

8. The antenna assembly of claim 1, wherein the shape memory alloy comprises a nickel-titanium shape memory alloy.

9. A system for wireless radio frequency processing, the system comprising:

a conductive antenna element comprising a first layer and a second layer that at least partially surrounds the first layer;

a temperature control system configured to increase or decrease a temperature of the conductive antenna element; and a controller operably coupled to the temperature control system and configured to:

detect deformation of the conductive antenna element, from a default configuration to a deformed configuration, caused by a deformation event; and instruct the temperature control system to either increase or decrease the temperature of the conductive antenna element in response to detecting deformation of the conductive antenna element.

10. The system of claim 9, wherein:

the first layer comprises a shape memory alloy configured to restore the conductive antenna element to the default configuration from the deformed configuration in response to the conductive antenna element being heated or cooled; and the second layer comprises an electrically conductive plating.

11. The system of claim 9, wherein:

the first layer comprises an electrically conductive material; and the second layer comprises a shape memory configured to restore the conductive antenna element to the default configuration from the deformed configuration in response to the conductive antenna element being heated or cooled.

12. The system of claim 9, wherein the controller comprises a sensor configured to detect deformation of the conductive antenna element.

13. The system of claim 9, further comprising a reflective element coupled to the conductive antenna element.

14. The system of claim 13, further comprising a radome that at least partially surrounds the conductive antenna element and the reflective element.

15. The system of claim 9, further comprising:

a plurality of conductive antenna elements, each having a dielectric rod and a sensor disposed within a circumference of a respective conductive antenna element; and a radome comprising a plurality of compartments, wherein each one of the plurality of conductive antenna elements is positioned within a corresponding one of the plurality of compartments of the radome.

16. The system of claim 15, wherein the controller is configured to adjust a configuration of each one of the plurality of conductive antenna elements to modify at least one of:

a radiation pattern formed by the plurality of conductive elements;

a phasing by each of the plurality of conductive elements; and a tuning of each of the plurality of conductive elements to form a set of optimal frequencies of operation that simultaneously form desired beam patterns.

17. A method comprising:

deforming a conductive antenna element from a default configuration to a deformed configuration; and restoring the conductive antenna element from the deformed configuration to the default configuration by modifying a temperature of a shape memory alloy of the conductive antenna element.

18. The method of claim 17, wherein the step of deforming the conductive antenna element comprises modifying the temperature of the shape memory alloy of the conductive antenna element.

19. The method of claim 17, wherein the step of restoring the conductive antenna element to the default configuration comprises tracking a history of strain and temperature and, based on the history and a predetermined hysteresis path, estimating a state of operation.

20. The method of claim 17, wherein the deformed configuration comprises a modification of at least one of a diameter, a pitch, an orientation, or a length of the conductive antenna element.

* * * * *